US009941067B2

(12) United States Patent
Guentner et al.

(10) Patent No.: US 9,941,067 B2
(45) Date of Patent: Apr. 10, 2018

(54) KEY MODULE AND SLIP-ON ELEMENT FOR A KEY MODULE

(71) Applicant: GMK Electronic Design GmbH, Wernberg-Koeblitz (DE)

(72) Inventors: Manfred Guentner, Pleystein (DE); Wolfgang Kredler, Gebenbach (DE); Sebastian Geilersdoerfer, Hahnbach (DE)

(73) Assignee: GMK Electronic Design GMBH, Wernberg-Koeblitz (DE)

( * ) Notice: Subject to any disclaimer, the term of this patent is extended or adjusted under 35 U.S.C. 154(b) by 88 days.

(21) Appl. No.: 15/021,569

(22) PCT Filed: Aug. 6, 2014

(86) PCT No.: PCT/EP2014/066933
§ 371 (c)(1),
(2) Date: Mar. 11, 2016

(87) PCT Pub. No.: WO2015/036183
PCT Pub. Date: Mar. 19, 2015

(65) Prior Publication Data

US 2016/0225552 A1 Aug. 4, 2016

(30) Foreign Application Priority Data

Sep. 12, 2013 (DE) ..... 10 2013 110 064

(51) Int. Cl.
*H01H 13/14* (2006.01)
*H01H 3/60* (2006.01)
(Continued)

(52) U.S. Cl.
CPC ..... *H01H 13/14* (2013.01); *H01H 3/60* (2013.01); *H01H 13/04* (2013.01); *H01H 13/84* (2013.01);
(Continued)

(58) Field of Classification Search
CPC ..... H01H 2221/062; H01H 2233/036; H01H 13/705; H01H 13/702; H01H 2221/03;
(Continued)

(56) References Cited

U.S. PATENT DOCUMENTS 5,247,143 A 9/1993 Suwa
5,380,969 A 1/1995 Yang
(Continued)

FOREIGN PATENT DOCUMENTS

DE 3229465 2/1984
DE 3530050 2/1987
(Continued)

OTHER PUBLICATIONS

Letter containing results from German Examination Report for PCT/EP2014/06693 dated Feb. 16, 2016.

*Primary Examiner* — Ahmed Saeed
(74) *Attorney, Agent, or Firm* — Workman Nydegger

(57) ABSTRACT

A key module has a housing and a tappet arranged in the housing. The tappet is movable in a linear manner between an upper stop position and a lower stop position in a manner limited by an upper stop and a lower stop, wherein an elastic element arranged in the housing pushes the tappet into the upper stop position, and wherein an actuating force exerted by a user pushes the tappet into the lower stop position and in the process reversibly compresses the elastic element. To reduce impact noises, the lower stop is formed by a first damping element and the upper stop is formed by a second damping element. The slip-on element has a carrier element to which a first damping element for reducing impact noises at the lower stop and a second damping element for reducing impact noises at the upper stop are attached.

23 Claims, 8 Drawing Sheets

(51) Int. Cl.
*H01H 13/04* (2006.01)
*H01H 13/84* (2006.01)

(52) U.S. Cl.
CPC ... *H01H 2221/03* (2013.01); *H01H 2221/062* (2013.01)

(58) Field of Classification Search
CPC ..... H01H 2233/056; H01H 2209/006; H01H 3/125; H01H 13/83
USPC ..... 200/341–345, 314, 315, 339, 553, 288, 200/5 A, 511, 245, 512
See application file for complete search history.

(56) References Cited

U.S. PATENT DOCUMENTS 5,990,435 A * 11/1999 Chao ..... H01H 13/702 200/345
6,876,837 B2 * 4/2005 Kuroshima ..... H01H 13/705 200/344
2008/0041706 A1 * 2/2008 Liu ..... H01H 13/705 200/335

FOREIGN PATENT DOCUMENTS

EP 0461283 12/1991
JP 2012138254 7/2012

* cited by examiner

KEY MODULE AND SLIP-ON ELEMENT FOR A KEY MODULE

CROSS-REFERENCE TO RELATED APPLICATIONS

The present invention is a 35 U.S.C. § 371 U.S. National Stage Application corresponding to PCT Application No. PCT/EP2014/066933, filed on Aug. 6, 2014, which claims priority to German Patent Application No. DE 10 2013 110 064.3, filed Sep. 12, 2013. The entire content of each of the aforementioned patent applications is incorporated herein by reference.

BACKGROUND OF THE INVENTION

1. Field of the Invention

The invention relates to a mechanical key module and to a slip-on element for a mechanical key module.

2. Background

Mechanical key modules form the basis of the user-actuated keys of keyboards. Typically, a computer keyboard has around one hundred key modules.

A mechanical key module comprises a housing and a tappet arranged in the housing, said tappet being movable in a linear manner between an upper stop position and a lower stop position in a manner limited by an upper stop and a lower stop. Here, an elastic element, for example a spring, arranged in the housing pushes the tappet into the upper stop position. As a result of an actuating force exerted by a user, the tappet is pushed into the lower stop position and the elastic element is reversibly compressed in the process. Via a corresponding connecting device, a suitable key button is usually attachable or attached to the tappet of the key module in order to form the user-actuated key.

Such key modules have been provided for many years for example by the company ZF Friedrichshafen AG, previously Cherry GmbH, under the name MX Technology or MX key module.

The impact noises which arise both when the keys are actuated and when they are released are a disadvantage of such known key modules. These impact noises are considered annoying in particular in offices with several PC workstations.

BRIEF SUMMARY OF THE INVENTION

The invention is based on the object of specifying a key module and a slip-on element for a key module, in which the impact noises that arise when a user actuates and releases the keys are reduced, preferably without or at least without noticeable negative changes to the switching characteristics and/or the lifetime of the key modules.

With regard to the key module, this object is achieved by the features of claim 1, and with regard to the slip-on element for a key module, it is achieved by the features of claim 13. Advantageous configurations and developments are specified in the respectively dependent claims.

The key module according to the invention comprises a housing and a tappet arranged in the housing, said tappet being movable in a linear manner between an upper stop position and a lower stop position in a manner limited by an upper stop and a lower stop. An elastic element, for example a spring, arranged in the housing pushes the tappet into the upper stop position, as long as no actuation force is acting on the tappet. However, if a user exerts an actuating force, the latter pushes the tappet into the lower stop position and reversibly compresses the elastic element.

According to the invention, provision is made for the lower stop to be formed by a first damping element in order to reduce impact noises, and for the upper stop to be formed by a second damping element in order to reduce impact noises.

The advantages of the invention are in particular that as a result of the upper and lower stop being formed by the first and second damping element, the impact noises at the lower and upper stop are reduced both when a user actuates and when the user releases the keys. Tests have shown that the impact noises can be reduced by up to 90% compared to identical key modules without these damping elements.

One development provides for the first damping element and second damping element to form a one-piece damping element or to be part of a one-piece damping element. These are also understood to include embodiments in which the first damping element and the second damping element are one and the same damping element, which implements the two damping actions at the upper and lower stop. Preferably, the one-piece damping element is configured and arranged such that it surrounds the tappet in an annular manner at least in the upper stop position thereof. The one-piece damping element can thus be a damping ring.

The first damping element and/or the second damping element and/or the abovementioned one-piece damping element comprising the first damping element and the second damping element may consist of or comprise elastic plastics material. The hardness of the respective damping elements can be varied as per the desired requirements by selection of a suitable plastics material. The elastic plastics material can be for example TPE (abbreviation for thermoplastic elastomers).

According to the invention, provision can be made for an upper stop surface formed on the tappet to interact at the upper stop with the second damping element in order to limit the linear movement of the tappet. Preferably, the second damping element forms at least one protruding second protuberance, for example a knob or an encircling circular sealing lip, for making contact with the upper stop surface.

One embodiment of the invention provides for the housing of the key module to have an opening for the tappet, a part of the tappet being moved out of the housing through the opening in the upper stop position of said tappet. The moved-out part of the tappet has a connecting device for attaching a key button to the tappet. This key button is arranged or arrangeable outside the housing of the key module. A user can actuate the key module via this key button and thus exert the actuating force on the tappet.

One development of this embodiment provides for a lower stop surface formed on the key button attached to the tappet to interact at the lower stop with the first damping element in order to limit the linear movement of the tappet. Preferably, the first damping element forms at least one protruding first protuberance, for example a knob or an encircling circular sealing lip, for making contact with the lower stop surface.

One variant embodiment of the key module according to the invention provides a slip-on element. This slip-on element has a carrier element to which the first damping element and the second damping element are attached. Furthermore, the carrier element has devices for slipping the slip-on element onto an outer side of the housing of the key module. Thus, the slip-on element forms that element of the key module that is responsible for noise damping. In this way, it is also possible to convert known key modules, for example the MX key modules discussed at the beginning, into a key module according to the invention for damping impact noises. The switching characteristics are not changed or are at least virtually not changed by the slip-on module.

The slip-on element comprising the carrier element and first damping element and second damping element can be produced by means of two-component injection-molding, for example. This allows cost-effective production.

The devices for slipping the slip-on element onto the outer side of the housing can be configured for example as latching elements. These latching elements are configured such that they are latchable or latched to the housing in order to form a solid connection. This allows fixed and secure positioning of the slip-on element with the damping elements on the housing of the key module, and slipping is prevented thereby. It is also possible for one or more of the latching elements to be configured as guide lugs which are formed such that even when the slip-on element is being slipped onto the housing, the slip-on element is guided such that it takes up the intended position on the housing and the taking up of an incorrect position is prevented. As a result, correct mounting and positioning of the slip-on element is both ensured and made easier.

The carrier element of the slip-on element can consist of or comprise for example plastics material, in particular the plastics materials ABS or PA or PP or a plastics compound comprising one or more of the abovementioned plastics materials.

The slip-on element can also be configured such that, in a state attached to the housing of the key module, it annularly surrounds the tappet of the key module at least in the upper stop position thereof.

As an alternative to the above-described variant embodiment of the key module with a slip-on element, a further variant embodiment of the key module provides for the first damping element and the second damping element, and thus optionally also the one-piece damping element, to be formed directly on the housing. In particular, the housing and first damping element and second damping element, and thus optionally also the one-piece damping element, can be produced jointly by means of two-component injection-molding. In contrast to the above-described variant embodiment, this variant thus provides for the direct integration of the damping elements into the housing of the key module, and thus the use of an additional component, for example the slip-on element described above and below, is dispensed with in this variant.

The slip-on element according to the invention is configured and intended for a key module having a housing and a tappet arranged in the housing, said tappet being movable in a linear manner between an upper stop position and a lower stop position in a manner limited by an upper stop and a lower stop. An elastic element arranged in the housing of the key module pushes the tappet into the upper stop position when no actuating force is exerted. If a user exerts an actuating force, the tappet of the key module is pushed into the lower stop position and the elastic element is reversibly compressed in the process. The key module can be for example the above-described key module according to the invention or one of the known key modules described at the beginning.

The invention provides for the slip-on element to have a carrier element to which a first damping element for reducing impact noises at the lower stop and a second damping element for reducing impact noises at the upper stop are attached. The first damping element and second damping element can also form a one-piece damping element or be part of a one-piece damping element. The first and second damping element can also be one and the same damping element.

Furthermore, the invention provides for the carrier element to have devices for slipping the slip-on element onto an outer side of the housing of the key module. These devices can be configured for example as latching elements which are latchable or latched to the housing in order to form a solid connection. This allows fixed and secure positioning of the slip-on element with the damping elements on the housing of the key module, and slipping is prevented thereby. It is also possible for one or more of the latching elements to be configured as guide lugs which are formed such that even when the slip-on element is being slipped onto the housing, the slip-on element is guided such that it takes up the intended position on the housing and the taking up of an incorrect position is prevented. As a result, correct mounting and positioning of the slip-on element is both ensured and made easier.

According to one development of the slip-on element, the first damping element and/or the second damping element and/or the one-piece damping element can consist of or comprise elastic plastics material, in particular elastic plastics material with a given hardness and/or TPE. Alternatively or in addition, provision can be made for the carrier element to consist of or comprise plastics material, in particular ABS or PA or PP or a plastics compound comprising one or more of the abovementioned plastics materials. Alternatively or in addition, provision can furthermore be made for the slip-on element comprising the carrier element and first damping element and second damping element, and thus optionally also the one-piece damping element, to be produced by means of two-component injection-molding.

One development of the slip-on element provides for the second damping element to be configured to interact, at the upper stop, with an upper stop surface formed on the tappet, in order to limit the linear movement of the tappet. Preferably, the second damping element can form at least one protruding second protuberance, for example a knob or an encircling circular sealing lip, for making contact with the upper stop surface. Alternatively or in addition, the first damping element can be configured to interact, at the lower stop, with a lower stop surface in order to limit the linear movement of the tappet. Preferably, the lower stop surface is formed on a key button which is attached to the tappet of the key module and is arranged outside the housing. In particular, the first damping element can form at least one protruding first protuberance, for example a knob or an encircling circular sealing lip, for making contact with the lower stop surface.

In embodiments, the slip-on element according to the invention can furthermore have all of the features described above with regard to the key module according to the invention.

Overall, solutions are proposed both with the key module according to the invention and with the slip-on element according to the invention, these solutions entailing a considerable reduction in impact noises and thus typing noises on keyboards, specifically both a reduction in the impact noises that arise when the keys are actuated and the impact noises that arise when the keys are released.

The proposed solutions allow fixed and secure positioning of the damping element(s) on the key module. The solutions furthermore provide a long lifetime and ensure at least virtually unchanged switching characteristics compared with comparable key modules that are not equipped with the damping elements.

The slip-on elements according to the invention and the key modules according to the invention that have these slip-on elements allow easy assembly of the key modules, and it is even possible to retrofit key modules, including the key modules mentioned at the beginning, for example the MX key modules, with the slip-on elements. Assembly is easy and can be carried out even by persons not skilled in the art.

The proposed solutions furthermore have the advantage that they do not take up any intermediate spaces provided in a keyboard between the individual key modules, and in this respect the keyboard structure is not changed.

Finally, the slip-on elements of the proposed solutions, but also the housing of the proposed key modules, can be produced cost effectively by conventional plastics injection-molding processes.

BRIEF DESCRIPTION OF THE DRAWINGS

The invention is explained in more detail in the following text, also with regard to further features and advantages, by way of the description of exemplary embodiments and with reference to the appended schematic drawings, in which FIG. 1 to FIG. 4 show perspective illustrations of a first exemplary embodiment of a key module according to the invention and a slip-on element according to the invention, wherein FIG. 1 shows a one-piece damping element, FIG. 2 a carrier element, FIG. 3 the slip-on element with the one-piece damping element and the carrier element, and FIG. 4 the key module with the slip-on element, FIGS. 5A-5B and FIGS. 6A-6B show sectional illustrations and enlarged detail-view illustrations of a second exemplary embodiment of a key module according to the invention and a slip-on element according to the invention, wherein FIGS. 5A-5B shows a lower stop position and FIGS. 6A-6B shows an upper stop position of the tappet, with FIGS. 5B and 6B showing detail views of sections A and B of FIGS. 5A and 6A respectively, and FIGS. 7A-7B and FIGS. 8A-8B show sectional illustrations and enlarged detail-view illustrations of a third exemplary embodiment of a key module according to the invention, in which the one-piece damping element is integrated into the housing and thus no slip-on element is provided, wherein FIGS. 7A-7B shows a lower stop position and FIGS. 8A-8B show an upper stop position of the tappet, with FIGS. 7B and 8B showing detail views of sections C and D of FIGS. 7A and 8A respectively.

Parts and components that correspond to one another are denoted by the same reference signs in the figures.

DETAILED DESCRIPTION OF THE PREFERRED EMBODIMENTS

Figure 1:
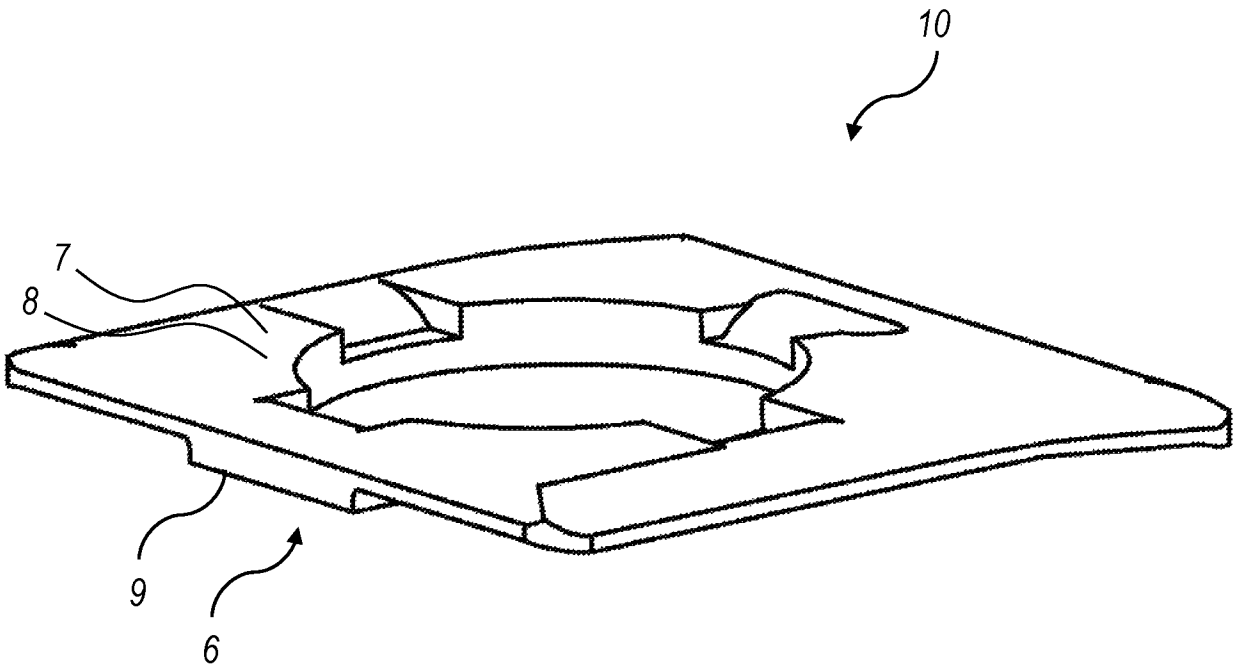
Figure 2:
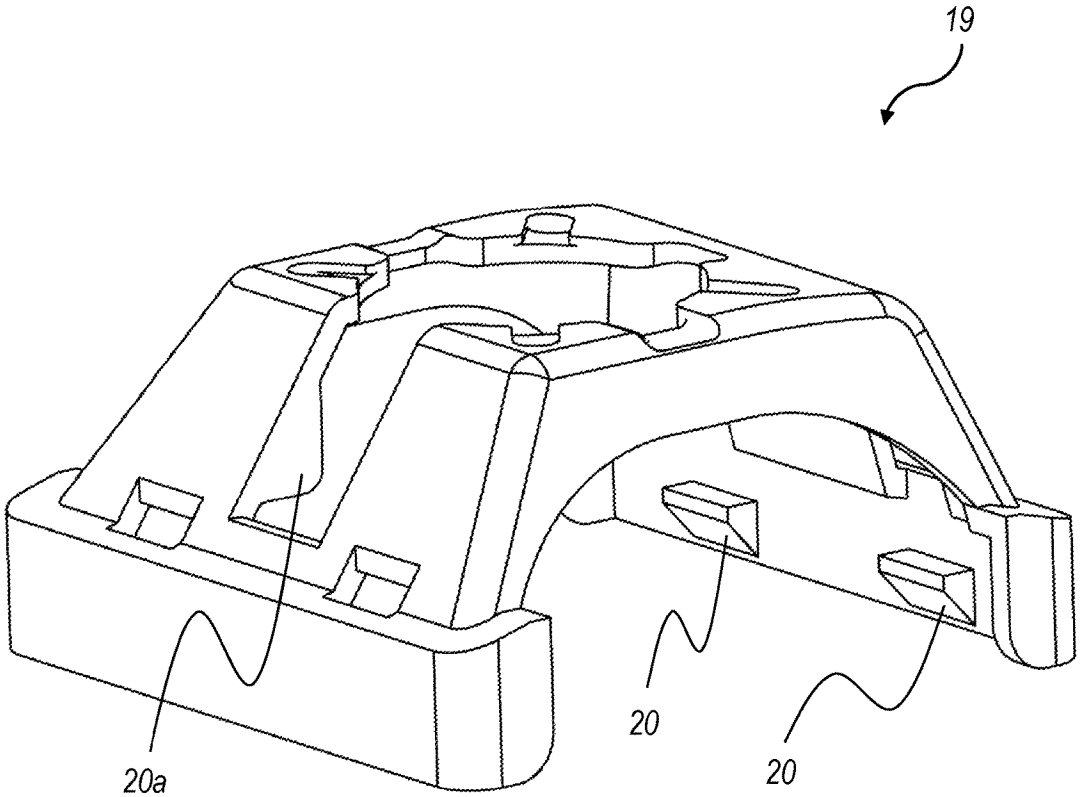
Figure 3:
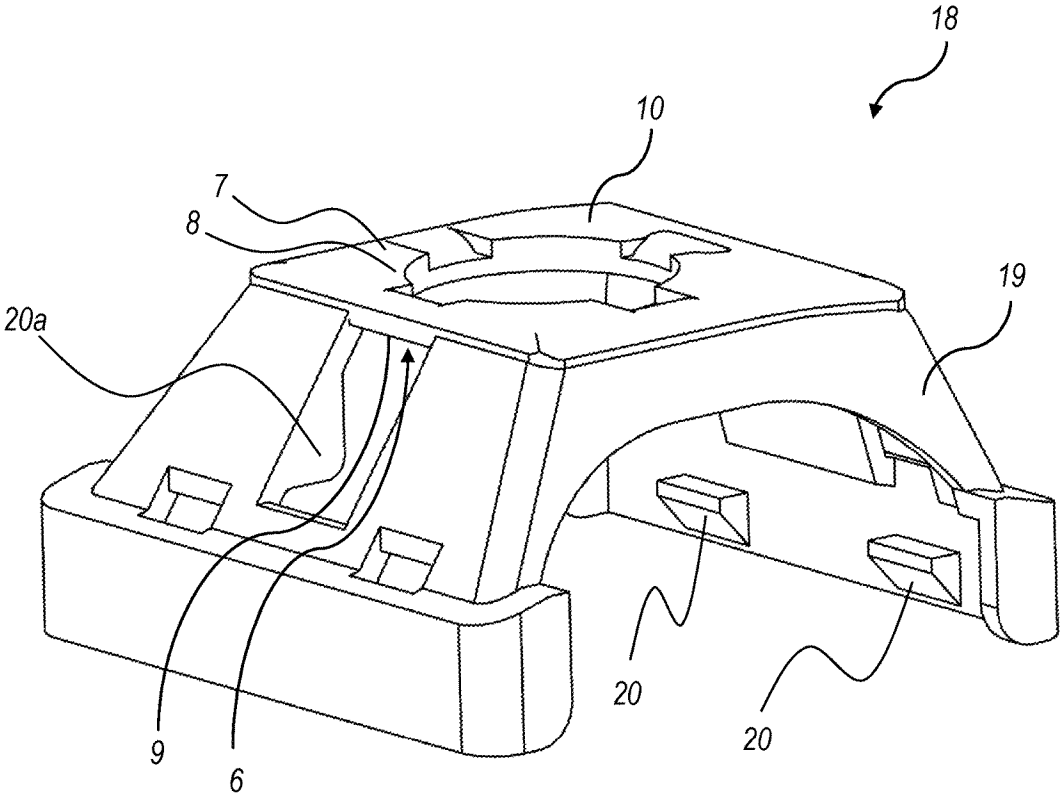

FIG. 1 to FIG. 4 show perspective illustrations of a first exemplary embodiment of a key module 1 according to the invention and a slip-on element 18 according to the invention. A one-piece damping element 10 is shown on its own in FIG. 1. The one-piece damping element 10 comprises a first damping element 8, which forms a lower stop 7 for a linear movement of the tappet 3, shown in FIG. 4, of the key module 1. Furthermore, the one-piece damping element 10 comprises a second damping element 9, which forms an upper stop 6 for the linear movement of the tappet 3 of the key module 1. FIG. 2 shows a carrier element 19 on its own, FIG. 3 shows the slip-on element 18 comprising this carrier element 19 and the one-piece damping element 10 shown in FIG. 1. The devices, configured as latching elements 20, for slipping the slip-on element 18 onto an outer side of a housing 2 of the key module 1 shown in FIG. 4 can be seen. Guide lugs 20*a* are furthermore provided as further latching elements, said guide lugs 20*a* being formed such that even when the slip-on element 18 is being slipped onto the housing 2, the slip-on element 18 is guided such that it takes up the intended position on the housing 2 and the taking up of an incorrect position is prevented.

Figure 4:
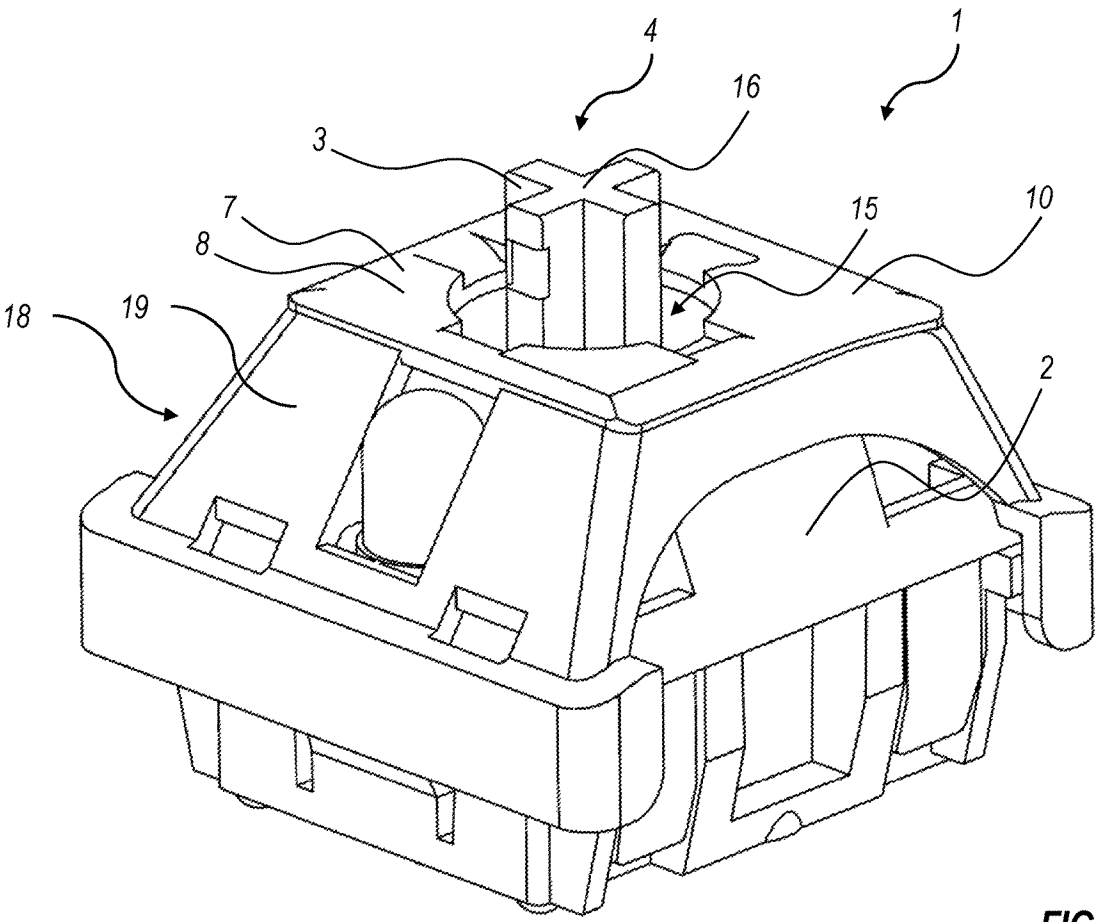

This key module 1 with the slipped-on slip-on element 18 is illustrated in FIG. 4. It can be seen that the tappet 3 already discussed has been moved out through an opening 15 in the housing 2. The tappet 3 is located in an upper stop position 4, into which it is pushed, in the absence of an actuating force by a user, by an elastic element (not shown in the drawings), for example a spring, arranged in the housing 2. This linear movement of the tappet 3 is stopped by the upper stop 6 formed by the second damping element 9, see FIG. 1. Specifically, an upper stop face (not illustrated) formed on the tappet 3 is pushed against the upper stop 6, formed by the second damping element 9.

At the free end of the tappet 3, a connecting device 16 can be seen in FIG. 4. Said connecting device 16 serves to attach a key button (not illustrated), via which a user can actuate the key module 1 by exerting an actuating force and can thus push the tappet 3 downwards in FIG. 4 and into the housing 2 until the linear movement of the tappet 3 is stopped by the lower stop 7, formed by the first damping element 8. Specifically, a lower stop surface (not illustrated) on the key button (not illustrated) pushes against the lower stop 7, formed by the first damping element 8. The tappet 3 is then located in a lower stop position (not illustrated).

Figure 5B:
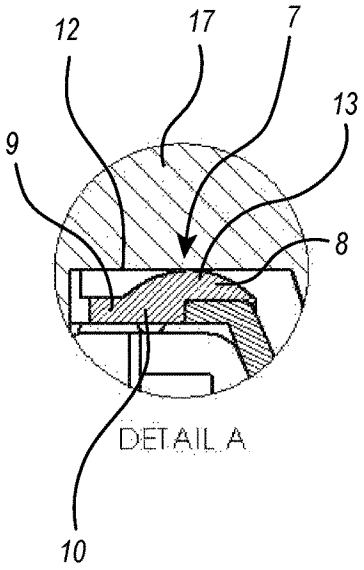
Figure 5A:
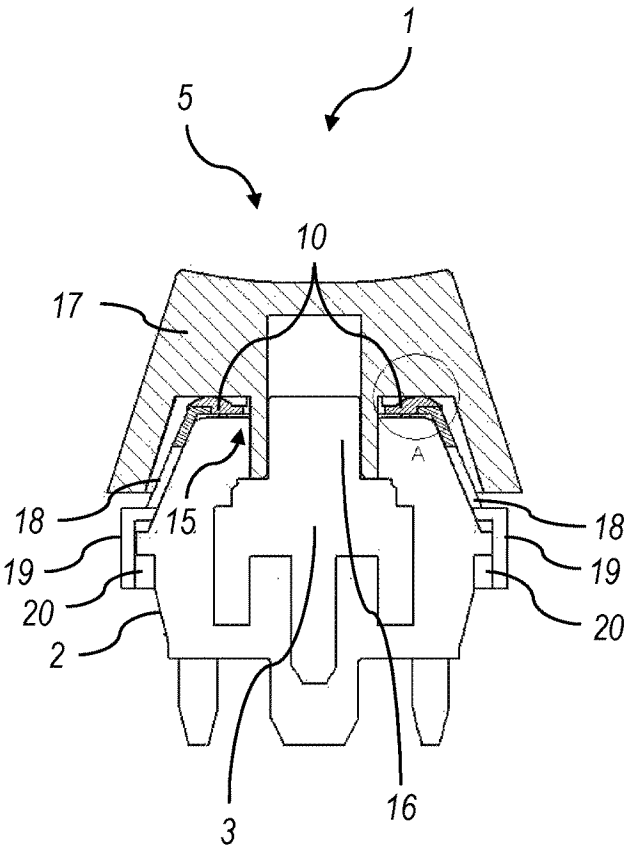
Figure 6B:
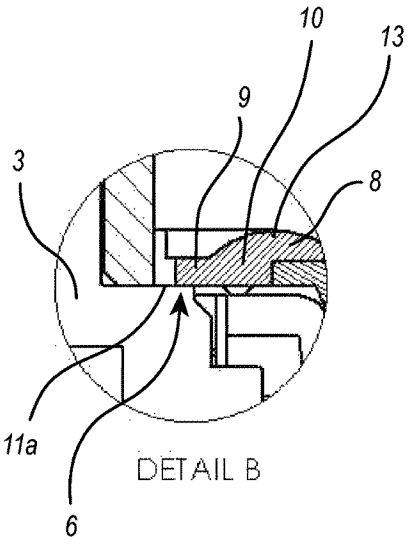
Figure 6A:
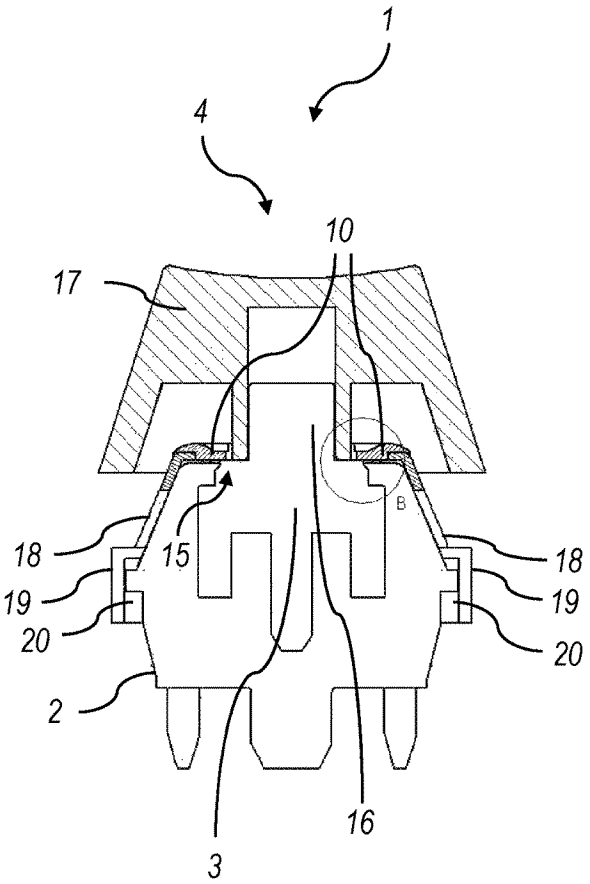

FIG. 5(A-B) and FIG. 6(A-B) show sectional illustrations and enlarged detail-view illustrations of a second exemplary embodiment of a key module 1 according to the invention and a slip-on element 18 according to the invention.

The key module 1 according to this second exemplary embodiment comprises a housing 2 and a tappet 3 arranged in the housing 2, said tappet 3 protruding partially through an opening 15 in the housing 2. Provided outside the housing 2 is a key button 17, which is slipped onto the tappet 3 by way of a connecting device 16 of the tappet 3. The tappet 3 is linearly movable, wherein the linear movement is limited by an upper stop 6 and a lower stop 7. FIG. 5(A-B) and FIG. 6(A-B) clarify this limitation of the linear movement. FIG. 5(A-B) shows a lower stop position 5 of the tappet 3, said lower stop position 5 being taken up upon actuation by a user by means of the exertion of an actuating force on the key button 17. FIG. 6(A-B) shows an upper stop position 4 of the tappet 3, said upper stop position 4 being taken up when the key button 17 is released by the user, that is to say no actuating force is exerted on the key button 17. The linear movement of the tappet 3 into the upper stop position 4 is brought about by an elastic element, for example a spring (not illustrated) arranged between the tappet 3 and housing 2, said spring pushing the tappet 3 against the upper stop 6.

It is clear from the enlarged detail-view illustrations in FIG. 5(A-B) and FIG. 6(A-B) that the lower stop 7 is formed by a first damping element 8 and the upper stop 6 is formed by a second damping element 9. The first damping element 8 and the second damping element 9 are part of a one-piece damping element 10 which annularly surrounds the tappet 3.

The enlarged detail-view illustrations in FIG. 5(A-B) and FIG. 6(A-B) furthermore show that a lower stop surface 12, which is formed on the key button 17, interacts, at the lower stop 7, with the first damping element 8 in order to limit the linear movement of the tappet 3. The first damping element 8 has a protruding first protuberance 13, encircling the tappet 3, for making contact with the lower stop surface 12. At the upper stop 6, an upper stop surface 11*a* formed on the tappet 3 interacts with the second damping element 9 in order to limit the linear movement of the tappet 3. In the example illustrated, the second damping element 9 is formed in a flat manner on the upper stop 6, without a protruding protuberance. Embodiments with a protuberance are also possible, however.

The one-piece damping element 10 comprising the first damping element 8 and the second damping element 9 is, in addition to a carrier element 19, part of the second exemplary embodiment of a slip-on element 18. The slip-on element 18 is slipped onto the outer side of the housing 2, and to this end latching elements 20 on the carrier element 19 are configured as devices for slipping on, said latching elements 20 being latched to the housing 2 in the slipped on state illustrated. The slip-on element 18 attached to the housing 2 annularly surrounds the tappet 3.

Figure 7B:
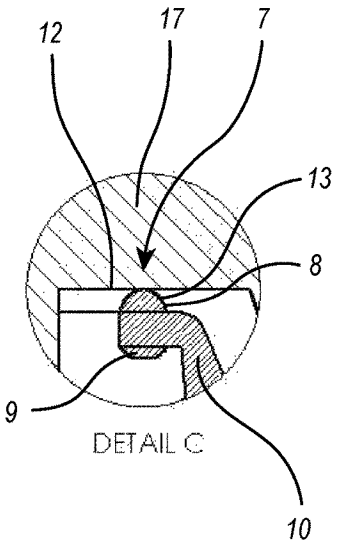
Figure 7A:
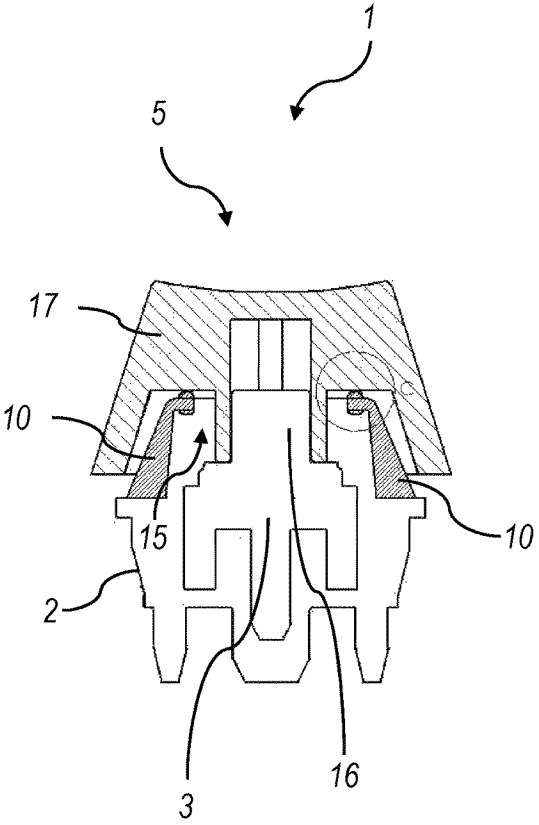
Figure 8B:
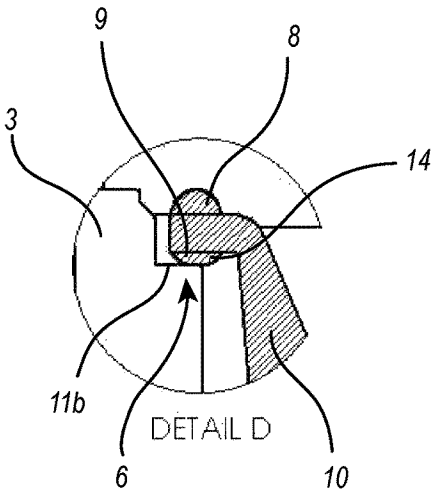
Figure 8A:
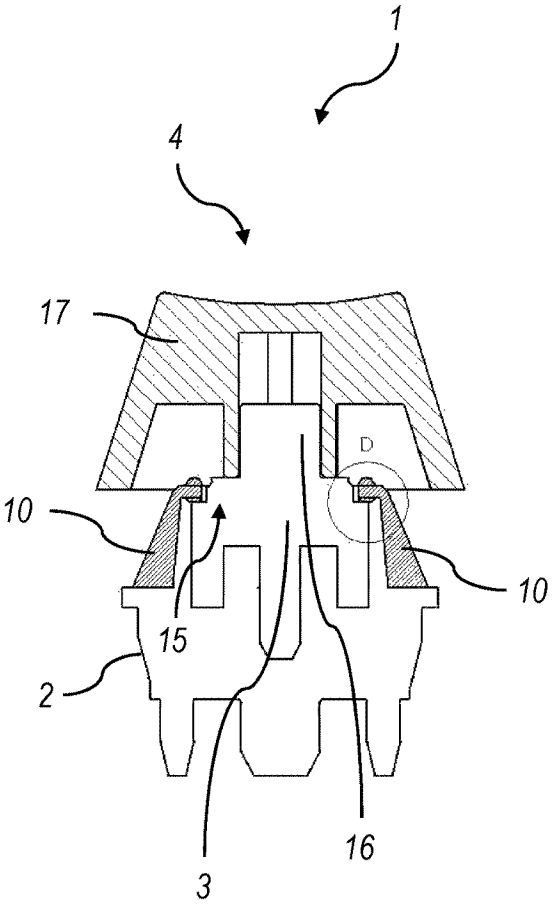

FIG. 7(A-B) and FIG. 8(A-B) show sectional illustrations and enlarged detail-view illustrations of a third exemplary embodiment of a key module 1 according to the invention.

The key module 1 according to this third exemplary embodiment comprises a housing 2 and a tappet 3 arranged in the housing 2, said tappet 3 protruding partially through an opening 15 in the housing 2. Provided outside the housing 2 is a key button 17, which is slipped onto the tappet 3 by way of a connecting device 16 of the tappet 3. The tappet 3 is linearly movable, wherein the linear movement is limited by an upper stop 6 and a lower stop 7. FIG. 7(A-B) and FIG. 8(A-B) clarify this limitation of the linear movement. FIG. 7(A-B) shows a lower stop position 5 of the tappet 3, said lower stop position 5 being taken up upon actuation by a user by means of the exertion of an actuating force on the key button 17. FIG. 8(A-B) shows an upper stop position 4 of the tappet 3, said upper stop position 4 being taken up when the key button 17 is released by the user, that is to say no actuating force is exerted on the key button 17. The linear movement of the tappet 3 into the upper stop position 4 is brought about by an elastic element, for example a spring (not illustrated) arranged between the tappet 3 and housing 2, said spring pushing the tappet 3 against the upper stop 6.

It is clear from the enlarged detail-view illustrations in FIG. 7(A-B) and FIG. 8(A-B) that the lower stop 7 is formed by a first damping element 8 and the upper stop 6 is formed by a second damping element 9. The first damping element 8 and the second damping element 9 are part of a one-piece damping element 10 which annularly surrounds the tappet 3.

The enlarged detail-view illustrations in FIG. 7(A-B) and FIG. 8(A-B) furthermore show that a lower stop surface 12, which is formed on the key button 17, interacts, at the lower stop 7, with the first damping element 8 in order to limit the linear movement of the tappet 3. The first damping element 8 has a protruding first protuberance 13, encircling the tappet 3, for making contact with the lower stop surface 12. At the upper stop 6, an upper stop surface 11*b* formed on the tappet 3 interacts with the second damping element 9 in order to limit the linear movement of the tappet 3. Comparing the tappet 3 of the exemplary embodiment according to FIG. 7(A-B) and FIG. 8(A-B) with the tappet 3 of the exemplary embodiment according to FIG. 5(A-B) and FIG. 6(A-B) shows that the tappets 3 are configured in an identical manner but that different surfaces 11*a* and 11*b* of the tappet 3 are used as the upper stop surface. In contrast to the second exemplary embodiment according to FIG. 5(A-B) and FIG. 6(A-B), in the example illustrated, the second damping element 9 has, at the upper stop 6, a protruding second protuberance 14, encircling the tappet 3, for making contact with the upper stop surface 11*b*. Flat embodiments, as shown in FIG. 5(A-B) and FIG. 6(A-B), are also possible, however.

In contrast to the second embodiment according to FIG. 5(A-B) and FIG. 6(A-B), the one-piece damping element 10 comprising the first damping element 8 and the second damping element 9 is not slipped onto the housing 2 as part of a slip-on element. Rather, the one-piece damping element 10 is formed directly on the housing 2 and thus integrated into the housing 2 on the outer side thereof. For example, the housing 2 and the one-piece damping element 10 can be produced jointly by means of two-component injection-molding.

The following applies to the first and second exemplary embodiments shown and described: The slip-on element 18 comprising the carrier element 19 and one-piece damping element 10 with the first damping element 8 and second damping element 9 can be produced by means of two-component injection-molding. The carrier element 19 can consist of or comprise plastics material, in particular ABS or PA or PP or a plastics compound comprising one or more of the abovementioned plastics materials. The one-piece damping element 10 with the first damping element 8 and second damping element 9 can consist of or comprise elastic plastics material, in particular elastic plastics material having a hardness selected as per the respective requirements, for example TPE. The latter also applies to the third exemplary embodiment.

The following applies to all three exemplary embodiments illustrated and described: The formation of the lower stop 7 and upper stop 6 by way of the first damping element 8 and second damping element 9, which are combined to form a one-piece damping element 10, ensures considerable damping of the impact noises both when the user actuates the key button 17 of the key module 1 and when the user releases the key button 17 of the key module 1.

LIST OF REFERENCE SIGNS

1 Key module
2 Housing
3 Tappet
4 Upper stop position
5 Lower stop position
6 Upper stop
7 Lower stop
8 First damping element
9 Second damping element
10 One-piece damping element
11*a* Upper stop surface
11*b* Upper stop surface
12 Lower stop surface
13 First protuberance on the first damping element 8
14 Second protuberance on the second damping element 9
15 Opening in the housing 2
16 Connecting device
17 Key button
18 Slip-on element
19 Carrier element
20 Latching element
20*a* Guide lug

We claim:

1. A key module comprising:

a) a housing;

b) a tappet arranged in the housing, said tappet being movable in a linear manner between an upper stop position and a lower stop position in a manner limited by an upper stop and a lower stop, wherein:

c) an elastic element arranged in the housing pushes the tappet into the upper stop position;

d) an actuating force exerted by a user pushes the tappet into the lower stop position and reversibly compresses the elastic element;

e) the lower stop is formed by a first damping element in order to reduce impact noises; and f) the upper stop is formed by a second damping element in order to reduce impact noises;

wherein:

the housing has an opening for the tappet, a part of the tappet being moved out of the housing through the opening in the upper stop position; the moved-out part of the tappet has a connecting device for attaching a key button to the tappet, wherein the key button is arranged or arrangeable outside the housing, and wherein a user can actuate the key module via the key button and thus exert the actuating force on the tappet; and a lower stop surface formed on the key button attached to the tappet interacts at the lower stop with the first damping element in order to limit the linear movement of the tappet.

2. The key module as claimed in claim 1, wherein: the first damping element and the second damping element form a one-piece damping element; and the one-piece damping element surrounds the tappet in an annular manner at least in the upper stop position thereof.

3. The key module as claimed in claim 1, wherein:

the first damping element and/or second damping element, and/or a one-piece damping element comprising the first damping element and the second damping element, comprises elastic plastics material.

4. The key module as claimed in in claim 1, wherein: an upper stop surface formed on the tappet interacts at the upper stop with the second damping element in order to limit the linear movement of the tappet; and the second damping element forms at least one protruding second protuberance for making contact with the upper stop surface.

5. The key module as claimed in claim 1, wherein:

the first damping element forms at least one protruding first protuberance for making contact with the lower stop surface.

6. The key module as claimed in claim 1, wherein:

provision is made of a slip-on element which has a carrier element to which the first damping element and the second damping element are attached; and the carrier element has devices for slipping the slip-on element onto an outer side of the housing.

7. The key module as claimed in claim 6, wherein the slip-on element comprising the carrier element, the first damping element and the second damping element is produced by two-component injection-molding.

8. The key module as claimed in claim 6, wherein: the devices for slipping the slip-on element onto the outer side of the housing are configured as latching elements which are latchable or latched to the housing in order to form a solid connection.

9. The key module as claimed claim 6, wherein:

the carrier element comprises plastics material.

10. The key module as claimed claim 6, wherein:

the slip-on element attached to the housing annularly surrounds the tappet at least in the upper stop position thereof.

11. The key module as claimed in claim 1, wherein:

the first damping element and the second damping element are formed directly on the housing.

12. A slip-on element for a key module comprising:

a1) a key module having a housing and a tappet arranged in the housing, said tappet being movable in a linear manner between an upper stop position and a lower stop position in a manner limited by an upper stop and a lower stop, wherein:

a2) an elastic element arranged in the housing of the key module pushes the tappet into the upper stop position;

a3) an actuating force exerted by a user pushes the tappet of the key module into the lower stop position and reversibly compresses the elastic element;

b1) the slip-on element has a carrier element to which a first damping element for reducing impact noises at the lower stop and a second damping element for reducing impact noises at the upper stop are attached, wherein the first damping element and second damping element form a one-piece damping element or are part of a one-piece damping element; and b2) the carrier element has devices for slipping the slip-on element onto an outer side of the housing of the key module, wherein these devices are configured as latching elements which are latchable to the housing in order to form a solid connection.

13. The slip-on element as claimed in claim 12, wherein:

the first damping element and/or the second damping element comprises elastic plastics material.

14. The slip-on element as claimed in claim 12, wherein:

the carrier element consists of or comprises plastics material.

15. The slip-on-elements as claimed in claim 12, wherein the slip-on element comprising the carrier element, the first damping element and the second damping element is produced by two-component injection-molding.

16. The slip-on element as claimed in claim 12, wherein:

the second damping element is configured to interact, at the upper stop, with an upper stop surface formed on the tappet, in order to limit the linear movement of the tappet; and the second damping element forms at least one protruding second protuberance for making contact with the upper stop surface.

17. The slip-on element as claimed in claim 12, wherein:

the first damping element is configured to interact, at the lower stop, with a lower stop surface in order to limit the linear movement of the tappet;

the lower stop surface is formed on a key button which is attached to the tappet of the key module and is arranged outside the housing; and the first damping element forms at least one protruding first protuberance for making contact with the lower stop surface.

18. A key module comprising:

a) a housing;

b) a tappet arranged in the housing, said tappet being movable in a linear manner between an upper stop position and a lower stop position in a manner limited by an upper stop and a lower stop, wherein:

c) an elastic element arranged in the housing pushes the tappet into the upper stop position;

d) an actuating force exerted by a user pushes the tappet into the lower stop position and reversibly compresses the elastic element;

e) the lower stop is formed by a first damping element in order to reduce impact noises; and f) the upper stop is formed by a second damping element in order to reduce impact noises;

wherein:

provision is made of a slip-on element which has a carrier element to which the first damping element and the second damping element are attached; and the carrier element has devices for slipping the slip-on element onto an outer side of the housing.

19. The key module as claimed in claim 18, wherein the slip-on element comprising the carrier element, the first damping element and the second damping element is produced by two-component injection-molding.

20. The key module as claimed in claim 18, wherein:

the devices for slipping the slip-on element onto the outer side of the housing are configured as latching elements which are latchable or latched to the housing in order to form a solid connection.

21. The key module as claimed claim 18, wherein:

the carrier element comprises plastics material.

22. The key module as claimed claim 18, wherein:

the slip-on element attached to the housing annularly surrounds the tappet at least in the upper stop position thereof.

23. The key module as claimed claim 18, wherein:

the housing has an opening for the tappet, a part of the tappet being moved out of the housing through the opening in the upper stop position;

the moved-out part of the tappet has a connecting device for attaching a key button to the tappet, wherein the key button is arranged or arrangeable outside the housing, and wherein a user can actuate the key module via the key button and thus exert the actuating force on the tappet; and a lower stop surface formed on the key button attached to the tappet interacts at the lower stop with the first damping element in order to limit the linear movement of the tappet.

* * * * *